US008668446B2

(12) United States Patent
Hofer et al.

(10) Patent No.: US 8,668,446 B2
(45) Date of Patent: Mar. 11, 2014

(54) SUPERSONIC COMPRESSOR ROTOR AND METHOD OF ASSEMBLING SAME

(75) Inventors: Douglas Carl Hofer, Clifton Park, NY (US); Zachary William Nagel, Ballston Lake, NY (US); David Graham Holmes, Schenectady, NY (US)

(73) Assignee: General Electric Company, Niskayuna, NY (US)

( * ) Notice: Subject to any disclaimer, the term of this patent is extended or adjusted under 35 U.S.C. 154(b) by 727 days.

(21) Appl. No.: 12/873,228

(22) Filed: Aug. 31, 2010

(65) Prior Publication Data

US 2012/0051933 A1 Mar. 1, 2012

(51) Int. Cl.
*F01D 5/14* (2006.01)

(52) U.S. Cl.
USPC ..... 415/181; 415/203; 416/236 R; 416/237

(58) Field of Classification Search
USPC ..... 29/889.21; 415/181, 203, 206; 416/223 A, 223 R, 235, 236 R, 237, 242
See application file for complete search history.

(56) References Cited

U.S. PATENT DOCUMENTS

| | | | | |
|---|---|---|---|---|
| 2,925,952 | A | 2/1960 | Garve | |
| 4,012,166 | A | 3/1977 | Kaesser et al. | |
| 4,199,296 | A | 4/1980 | de Chair | |
| 4,463,772 | A | 8/1984 | Ball | |
| 4,620,679 | A | 11/1986 | Karanian | |
| 4,704,861 | A | 11/1987 | Mowill | |
| 4,791,784 | A * | 12/1988 | Minardi et al. | 60/262 |
| 5,061,154 | A * | 10/1991 | Kington | 416/186 R |
| 5,062,766 | A * | 11/1991 | Miura et al. | 415/199.1 |
| 5,228,832 | A * | 7/1993 | Nishida et al. | 415/208.1 |

(Continued)

FOREIGN PATENT DOCUMENTS

| | | |
|---|---|---|
| EP | 1126133 A2 | 8/2001 |
| GB | 885661 | 12/1961 |
| WO | 2009025803 A1 | 2/2009 |

OTHER PUBLICATIONS

Shawn P. Lawlor and Peter Baldwin, Conceptual Design of a Supersonic CO2 Compressor, Proceedings of ASME 2005, ASME Turbo Expo 2005, Jun. 6-9, 2005, 8 pages, Ramgen Power Systems, Bellevue, WA.

(Continued)

*Primary Examiner* — Edward Look
*Assistant Examiner* — Liam McDowell
(74) *Attorney, Agent, or Firm* — Andrew J. Caruso

(57) ABSTRACT

A supersonic compressor rotor. The supersonic compressor rotor includes a rotor disk that includes an upstream surface, a downstream surface, and a radially outer surface that extends generally axially between the upstream surface and the downstream surface. The radially outer surface includes an inlet surface, an outlet surface, and a transition surface that extends between the inlet surface and the outlet surface. A plurality of vanes are coupled to the radially outer surface. Adjacent vanes form a pair and are oriented such that a flow channel is defined between each pair of adjacent vanes. The flow channel extends between an inlet opening and an outlet opening. The inlet surface defines an inlet plane that extends between the inlet opening and the transition surface. The outlet surface defines an outlet plane that extends between the outlet opening and the transition surface that is not parallel to the inlet plane. At least one supersonic compression ramp is positioned within the flow channel to facilitate forming at least one compression wave within the flow channel.

20 Claims, 13 Drawing Sheets

(56) References Cited

U.S. PATENT DOCUMENTS

| | | | | |
|---|---|---|---|---|
| 5,236,301 | A * | 8/1993 | Palmer | 415/116 |
| 5,525,038 | A | 6/1996 | Sharma et al. | |
| 5,881,758 | A | 3/1999 | Koncsek et al. | |
| 6,358,003 | B2 | 3/2002 | Schlechtriem | |
| 6,428,271 | B1 | 8/2002 | Ress, Jr. et al. | |
| 6,488,469 | B1 | 12/2002 | Yousser et al. | |
| 7,070,388 | B2 | 7/2006 | Meng et al. | |
| 7,293,955 | B2 | 11/2007 | Lawlor et al. | |
| 7,296,396 | B1 | 11/2007 | Wilson et al. | |
| 7,334,990 | B2 | 2/2008 | Lawlor et al. | |
| 7,337,606 | B2 | 3/2008 | Brouillette et al. | |
| 7,434,400 | B2 | 10/2008 | Lawlor et al. | |
| 7,866,937 | B2 * | 1/2011 | Schlote | 415/1 |
| 2005/0260074 | A1 * | 11/2005 | Higashimori | 415/206 |
| 2006/0024152 | A1 * | 2/2006 | Wiedermann et al. | 415/121.2 |
| 2009/0107557 | A1 | 4/2009 | Conners | |
| 2009/0196731 | A1 | 8/2009 | Lawlor | |
| 2010/0005763 | A1 | 1/2010 | Bloom | |
| 2010/0043389 | A1 | 2/2010 | Conners | |

OTHER PUBLICATIONS

H.J. Lichtfuss, H. Starken, Supersonic Cascade Flow, Progress in Aerospace Sciences vol. 15, 1974, pp. 37-149.

M. F. El-Dosoky, A. Rona and J. P. Gostelow, An Analytical Model for Over-Shroud Leakage Losses in a Shrouded Turbine Stage, ASME Turbo Expo 2007, Power for Land, Sea and Air, GT2007, May 2007, pp. 1-10, Montreal Canada.

Allan D. Grosvenor, David A. Taylor, Jonathan R. Bucher, Michael J. Aarnio, Paul M. Brown, Robert D. Draper, Shawn P. Lawlor, Measured and Predicted Performance of a High Pressure Ratio Supersonic Compressor Rotor, ASME Turbo Expo 2008, Power for Land, Sea and Air, GT2008, Jun. 2008, pp. 1-12, Berlin, Germany.

* cited by examiner

SUPERSONIC COMPRESSOR ROTOR AND METHOD OF ASSEMBLING SAME

BACKGROUND OF THE INVENTION

The subject matter described herein relates generally to supersonic compressor systems and, more particularly, to a supersonic compressor rotor for use with a supersonic compressor system.

At least some known supersonic compressor assemblies include an intake section, a discharge section, and at least one supersonic compressor rotor positioned between the intake section and the discharge section.

Known supersonic compressor rotors include a plurality of strakes coupled to a rotor disk. Each strake is oriented circumferentially about the rotor disk and define an axial flow channel between adjacent strakes. At least some known supersonic compressor rotors include a supersonic compression ramp that is coupled to the rotor disk. Known supersonic compression ramps are positioned within the axial flow path and are configured to form a compression wave within the flow path. Known supersonic compressor assemblies include intake sections that include axially-oriented flow paths to facilitate channeling fluid in an axial direction. Additionally, at least some known supersonic compressor assemblies include discharge sections that are configured to receive axially-oriented fluid flow from known supersonic compressor rotors.

During operation of at least some known supersonic compressor assemblies, a supersonic compressor rotor is rotated at a high rotational speed. A fluid is channeled in an axial direction from the intake section to the supersonic compressor rotor such that the fluid is characterized by a velocity that is supersonic with respect to the supersonic compressor rotor. At least some known supersonic compressor rotors discharge fluid in the axial direction. As fluid is channeled in the axial direction, the discharge section positioned downstream of the supersonic compressor rotor are required to be designed to receive an axially-oriented flow. Known supersonic compressor systems are described in, for example, U.S. Pat. Nos. 7,334,990 and 7,293,955 filed Mar. 28, 2005 and Mar. 23, 2005 respectively, and United States Patent Application 2009/0196731 filed Jan. 16, 2009.

BRIEF DESCRIPTION OF THE INVENTION

In one embodiment, a supersonic compressor rotor is provided. The supersonic compressor rotor includes a rotor disk that includes an upstream surface, a downstream surface, and a radially outer surface that extends between the upstream surface and the downstream surface. The radially outer surface includes an inlet surface, an outlet surface, and a transition surface that extends between the inlet surface and the outlet surface. The rotor disk defines a centerline axis. A plurality of vanes are coupled to the radially outer surface. Adjacent vanes form a pair and are oriented such that a flow channel is defined between each pair of adjacent vanes. The flow channel extends between an inlet opening and an outlet opening. The inlet surface defines an inlet plane that extends between the inlet opening and the transition surface. The outlet surface defines an outlet plane that extends between the outlet opening and the transition surface that is not parallel to the inlet plane. At least one supersonic compression ramp is positioned within the flow channel to facilitate forming at least one compression wave within the flow channel.

In another embodiment, a supersonic compressor system is provided. The supersonic compressor system includes a casing that defines a cavity that extends between a fluid inlet and a fluid outlet. A drive shaft is positioned within the casing and defines a centerline axis. The drive shaft is rotatably coupled to a driving assembly. A supersonic compressor rotor is coupled to the drive shaft. The supersonic compressor rotor is positioned between the fluid inlet and the fluid outlet for channeling fluid from the fluid inlet to the fluid outlet. The supersonic compressor rotor includes a rotor disk that includes an upstream surface, a downstream surface, and a radially outer surface that extends between the upstream surface and the downstream surface. The radially outer surface includes an inlet surface, an outlet surface, and a transition surface that extends between the inlet surface and the outlet surface. A plurality of vanes are coupled to the radially outer surface. Adjacent vanes form a pair and are oriented such that a flow channel is defined between each pair of adjacent vanes. The flow channel extends between an inlet opening and an outlet opening. The inlet surface defines an inlet plane that extends between the inlet opening and the transition surface. The outlet surface defines an outlet plane that extends between the outlet opening and the transition surface that is not parallel to the inlet plane. At least one supersonic compression ramp is positioned within the flow channel to facilitate forming at least one compression wave within the flow channel.

In yet another embodiment, a method of assembling a supersonic compressor rotor is provided. The method includes providing a rotor disk that includes an upstream surface, a downstream surface, and a radially outer surface that extends between the upstream surface and the downstream surface. The radially outer surface includes an inlet surface, an outlet surface, and a transition surface that extends between the inlet surface and the outlet surface. The rotor disk defines a centerline axis. A plurality of vanes are coupled to the radially outer surface. Adjacent vanes form a pair and are oriented such that a flow channel is defined between each pair of adjacent vanes. The flow channel extends between an inlet opening and an outlet opening. The inlet surface defines an inlet plane that extends between the inlet opening and the transition surface. The outlet surface defines an outlet plane that extends between the outlet opening and the transition surface that is not parallel to the inlet plane. At least one supersonic compression ramp is coupled to one of a vane of the plurality of vanes and the radially outer surface. The supersonic compression ramp is positioned within the flow channel and is configured to facilitate forming at least one compression wave within the flow channel.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

Figure 1:
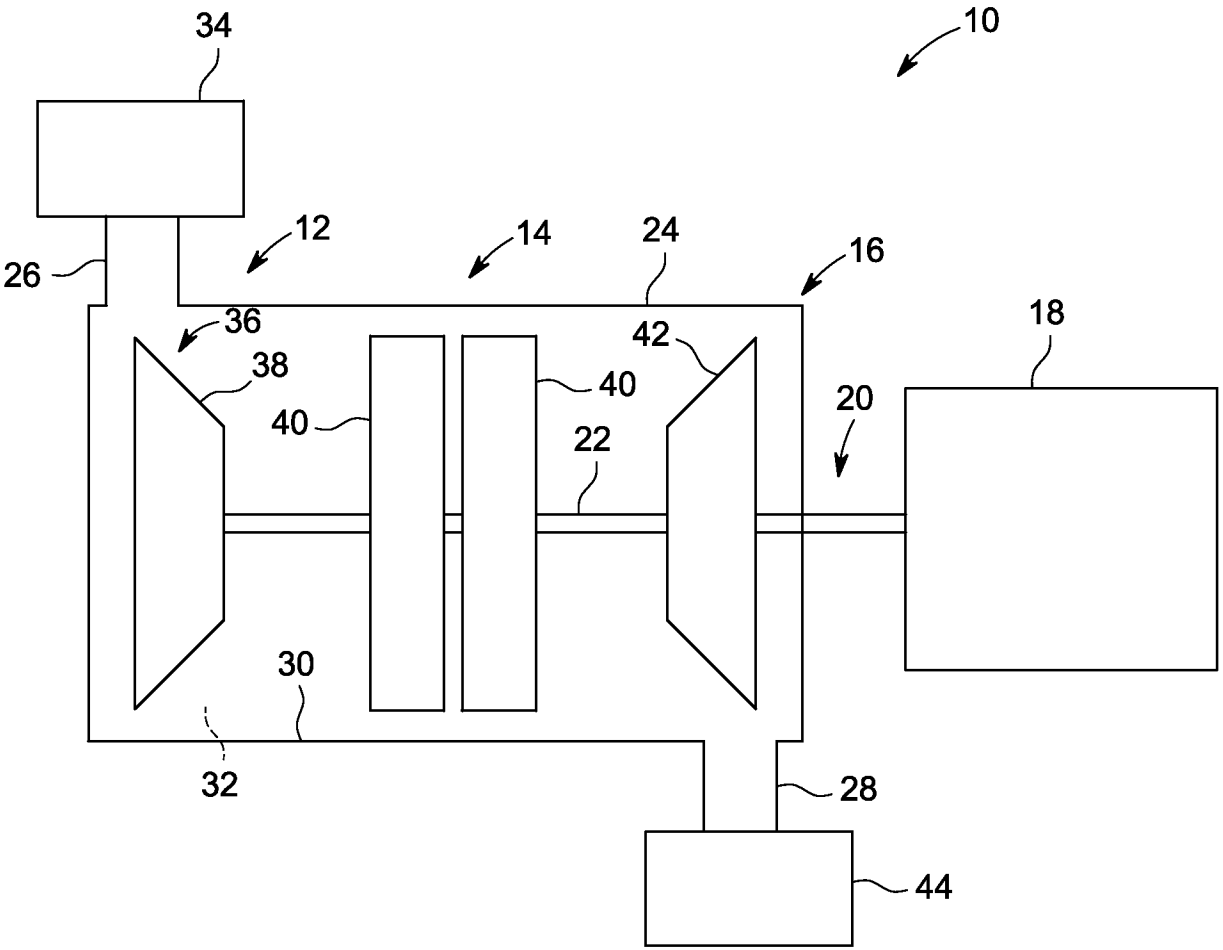
FIG. 1 is a schematic view of an exemplary supersonic compressor system.

Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION OF THE INVENTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor rotor" refers to a compressor rotor comprising a supersonic compression ramp disposed within a fluid flow channel of the supersonic compressor rotor. Supersonic compressor rotors are said to be "supersonic" because they are designed to rotate about an axis of rotation at high speeds such that a moving fluid, for example a moving gas, encountering the rotating supersonic compressor rotor at a supersonic compression ramp disposed within a flow channel of the rotor, is said to have a relative fluid velocity which is supersonic. The relative fluid velocity can be defined in terms of the vector sum of the rotor velocity at the supersonic compression ramp and the fluid velocity just prior to encountering the supersonic compression ramp. This relative fluid velocity is at times referred to as the "local supersonic inlet velocity", which in certain embodiments is a combination of an inlet gas velocity and a tangential speed of a supersonic compression ramp disposed within a flow channel of the supersonic compressor rotor. The supersonic compressor rotors are engineered for service at very high tangential speeds, for example tangential speeds in a range of 300 meters/second to 800 meters/second.

The exemplary systems and methods described herein overcome disadvantages of known supersonic compressor assemblies by providing a supersonic compressor rotor that facilitates adjusting an orientation of a fluid through a flow path of the supersonic compressor. More specifically, the supersonic compressor rotor includes a transition surface that transitions an orientation of a flow path. Moreover, the embodiments described herein include a supersonic compression rotor that includes an inlet surface and an outlet surface that is not parallel to the inlet surface. In addition, providing a supersonic compressor rotor as described herein enables a supersonic compressor system to be designed to include each of an axial intake orientation, a radial intake orientation, an oblique intake orientation, an axial discharge orientation, a radial discharge orientation, and/or an oblique discharge orientation.

FIG. 1 is a schematic view of an exemplary supersonic compressor system 10. In the exemplary embodiment, supersonic compressor system 10 includes an intake section 12, a compressor section 14 coupled downstream from intake section 12, a discharge section 16 coupled downstream from compressor section 14, and a drive assembly 18. Compressor section 14 is coupled to drive assembly 18 by a rotor assembly 20 that includes a drive shaft 22. In the exemplary embodiment, each of intake section 12, compressor section 14, and discharge section 16 are positioned within a compressor housing 24. More specifically, compressor housing 24 includes a fluid inlet 26, a fluid outlet 28, and an inner surface 30 that defines a cavity 32. Cavity 32 extends between fluid inlet 26 and fluid outlet 28 and is configured to channel a fluid from fluid inlet 26 to fluid outlet 28. Each of intake section 12, compressor section 14, and discharge section 16 are positioned within cavity 32. Alternatively, intake section 12 and/or discharge section 16 may not be positioned within compressor housing 24.

In the exemplary embodiment, fluid inlet 26 is configured to channel a flow of fluid from a fluid source 34 to intake section 12. The fluid may be any fluid such as, for example a gas, a gas mixture, and/or a liquid-gas mixture. Intake section 12 is coupled in flow communication with compressor section 14 for channeling fluid from fluid inlet 26 to compressor section 14. Intake section 12 is configured to condition a fluid flow having one or more predetermined parameters, such as a velocity, a mass flow rate, a pressure, a temperature, and/or any suitable flow parameter. In the exemplary embodiment, intake section 12 includes an inlet guide vane assembly 36 that is coupled between fluid inlet 26 and compressor section 14 for channeling fluid from fluid inlet 26 to compressor section 14. Inlet guide vane assembly 36 includes one or more inlet guide vanes 38 that are coupled to compressor housing 24.

Compressor section 14 is coupled between intake section 12 and discharge section 16 for channeling at least a portion of fluid from intake section 12 to discharge section 16. Compressor section 14 includes at least one supersonic compressor rotor 40 that is rotatably coupled to drive shaft 22. Supersonic compressor rotor 40 is configured to increase a pressure of fluid, reduce a volume of fluid, and/or increase a temperature of fluid being channeled to discharge section 16. Discharge section 16 includes an outlet guide vane assembly 42 that is coupled between supersonic compressor rotor 40 and fluid outlet 28 for channeling fluid from supersonic compressor rotor 40 to fluid outlet 28. Fluid outlet 28 is configured to channel fluid from outlet guide vane assembly 42 and/or supersonic compressor rotor 40 to an output system 44 such as, for example, a turbine engine system, a fluid treatment system, and/or a fluid storage system. Drive assembly 18 is configured to rotate drive shaft 22 to cause a rotation of supersonic compressor rotor 40, and/or outlet guide vane assembly 42.

During operation, intake section 12 channels fluid from fluid source 34 towards compressor section 14. Compressor section 14 compresses the fluid and discharges the compressed fluid towards discharge section 16. Discharge section 16 channels the compressed fluid from compressor section 14 to output system 44 through fluid outlet 28.

Figure 2:
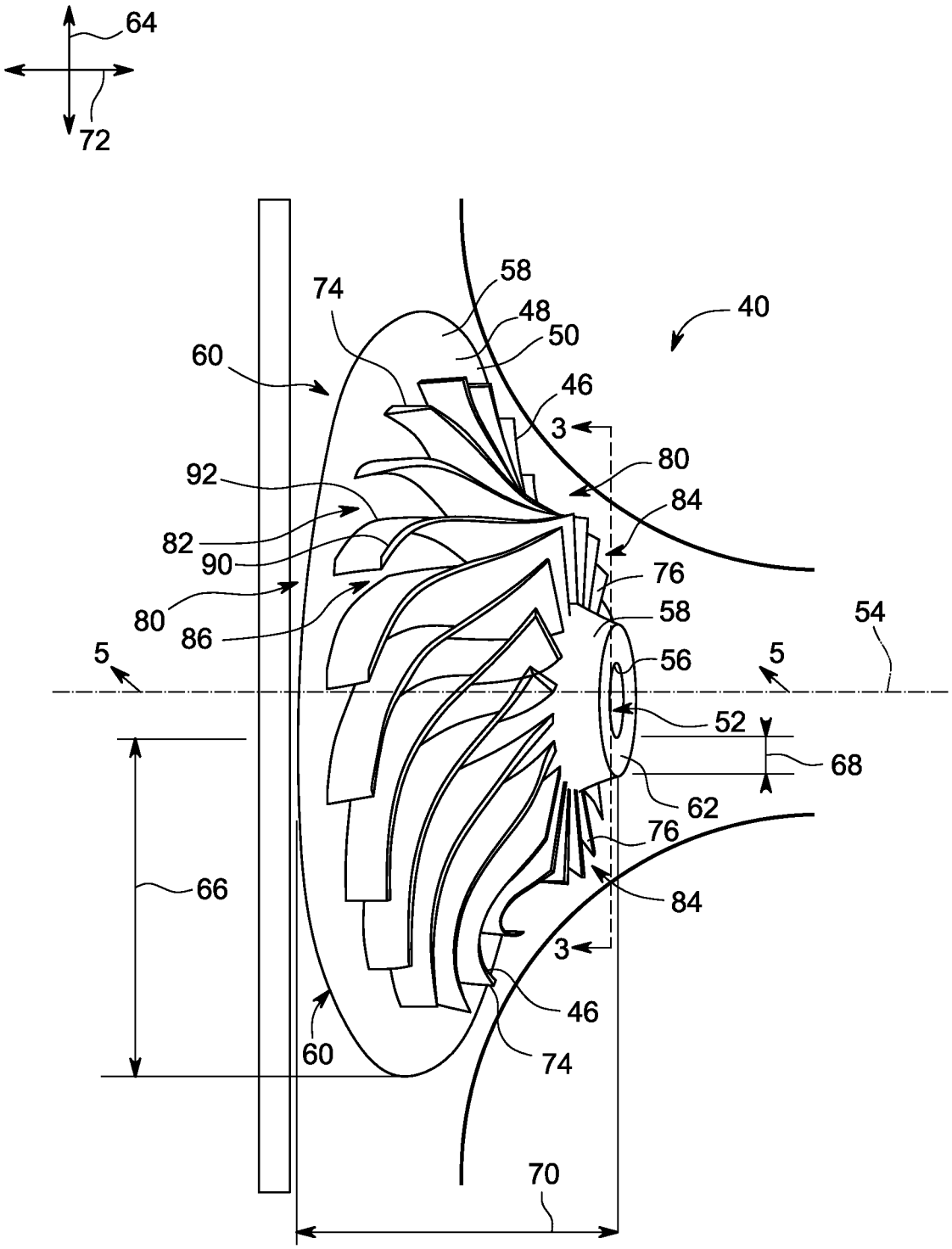
FIG. 2 is a perspective view of an exemplary supersonic compressor rotor that may be used with the supersonic compressor system shown in FIG. 1.
Figure 3:
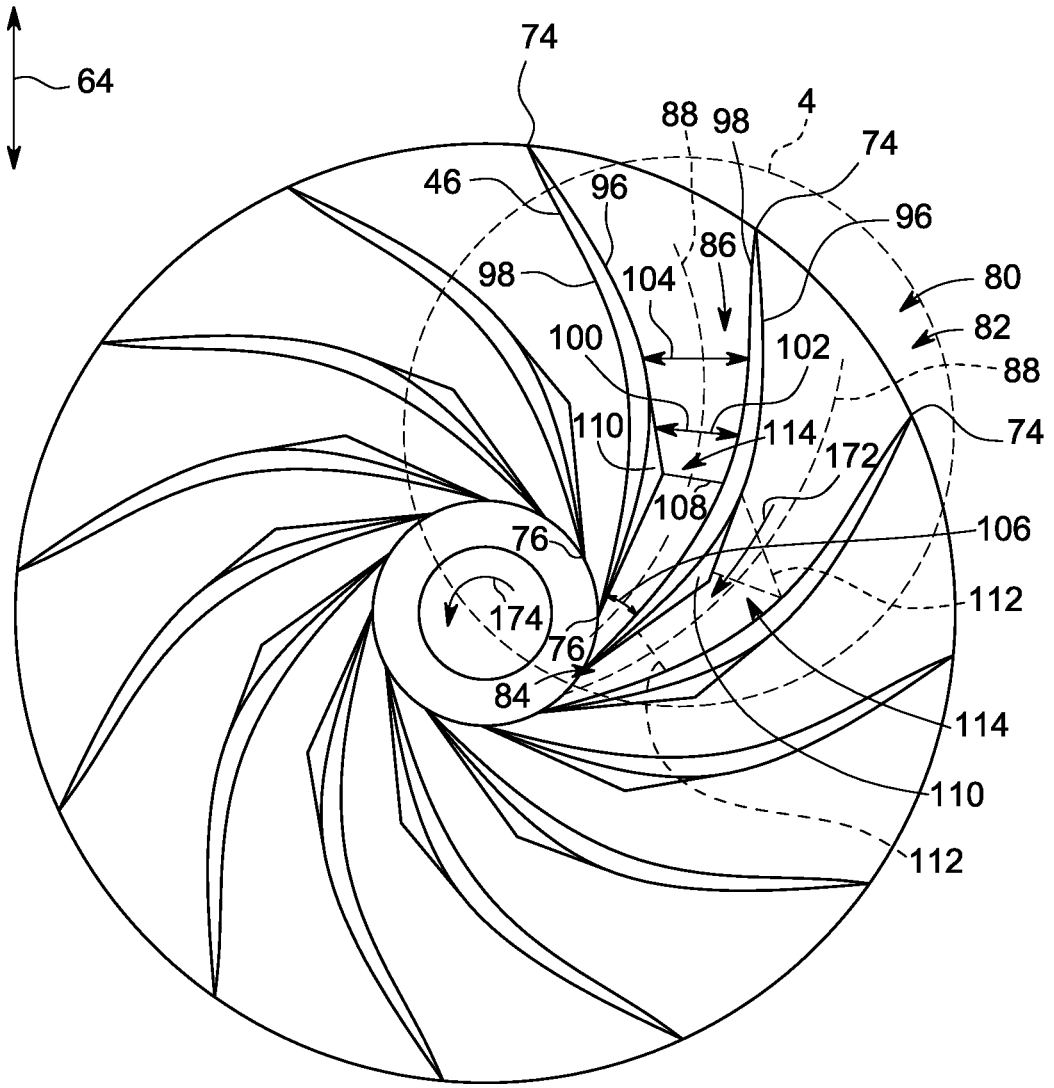
FIG. 3 is a perspective view of the supersonic compressor rotor shown in FIG. 2 taken along line 3-3 in FIG. 2.
Figure 4:
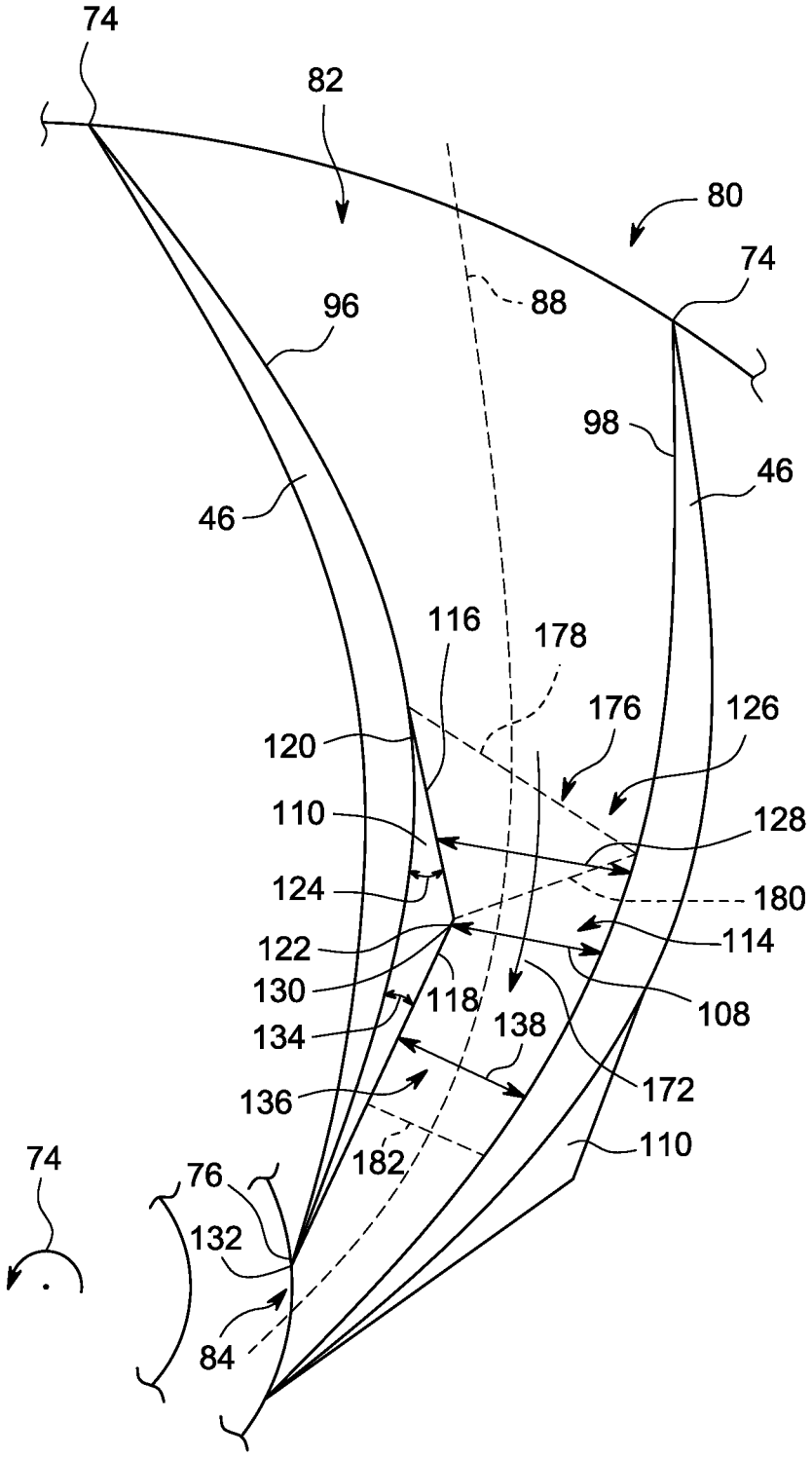
FIG. 4 is an enlarged cross-sectional view of a portion of the supersonic compressor rotor shown in FIG. 3 and taken along area 4.
Figure 5:
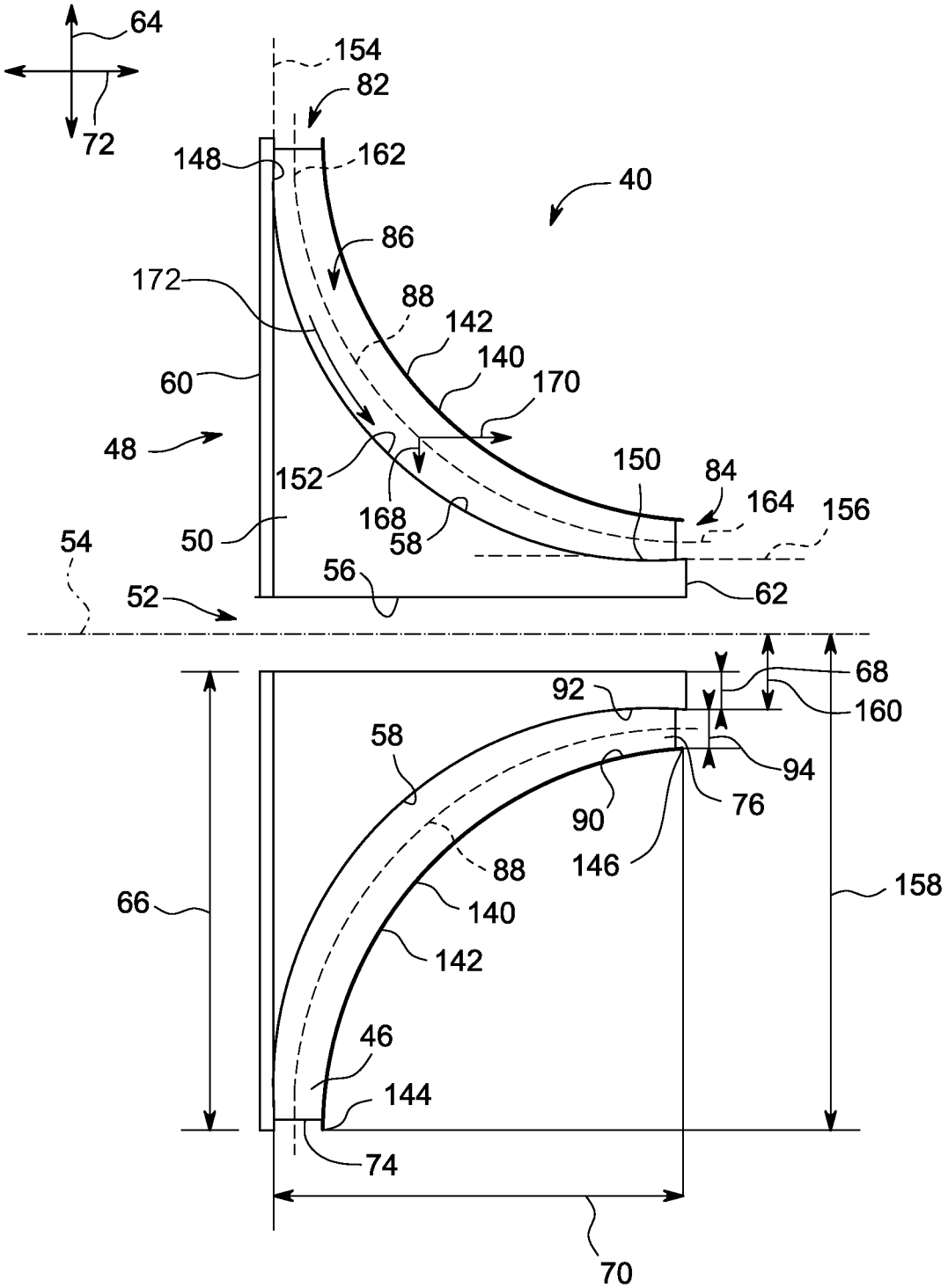
FIG. 5 is another cross-sectional view of the supersonic compressor rotor shown in FIG. 2 taken along line 5-5 in FIG. 2.

FIG. 2 is a perspective view of an exemplary supersonic compressor rotor 40. FIG. 3 is a cross-sectional view of supersonic compressor rotor 40 taken along sectional line 3-3 shown in FIG. 2. FIG. 4 is an enlarged cross-sectional view of a portion of supersonic compressor rotor 40 taken along area 4. FIG. 5 is a cross-sectional view of supersonic compressor rotor 40 taken along section line 5-5 shown in FIG. 2. Identical components shown in FIGS. 3-5 are labeled with the same reference numbers used in FIG. 2. In the exemplary embodiment, supersonic compressor rotor 40 includes a plurality of vanes 46 that are coupled to a rotor disk 48. Rotor disk 48 includes an annular disk body 50 that defines an inner cylindrical cavity 52 extending generally axially through disk body 50 along a centerline axis 54. Disk body 50 includes a radially inner surface 56 and a radially outer surface 58. Radially inner surface 56 defines inner cylindrical cavity 52. Inner cylindrical cavity 52 has a substantially cylindrical shape and is oriented about centerline axis 54. Inner cylindrical cavity 52 is sized to receive drive shaft 22 (shown in FIG. 1) therethrough. Rotor disk 48 also includes an upstream surface 60 and a downstream surface 62. Each upstream surface 60 and downstream surface 62 extends between radially inner surface 56 and radially outer surface 58 in a radial direction 64 that is generally perpendicular to centerline axis 54. Upstream surface 60 includes a first radial width 66 that is defined between radially inner surface 56 and radially outer surface 58. Downstream surface 62 includes a second radial width 68 that is defined between radially inner surface 56 and radially outer surface 58. In the exemplary embodiment, first radial width 66 is larger than second radial width 68. Alternatively, first radial width 66 may be less than, or equal to, second radial width 68.

In the exemplary embodiment, radially outer surface 58 is coupled between upstream surface 60 and downstream surface 62, and extends a distance 70 defined from upstream surface 60 to downstream surface 62 in an axial direction 72 that is generally parallel to centerline axis 54.

In the exemplary embodiment, each vane 46 is coupled to radially outer surface 58 and extends outwardly from radially outer surface 58. Each vane 46 includes an upstream edge 74, a downstream edge 76. Upstream edge 74 is positioned adjacent upstream surface 60 of rotor disk 48. Downstream edge 76 is positioned adjacent downstream surface 62. In the exemplary embodiment, supersonic compressor rotor 40 includes a pair 80 of vanes 46. Each pair 80 is oriented to define an inlet opening 82, an outlet opening 84, and a flow channel 86 between adjacent vanes 46. Flow channel 86 extends between inlet opening 82 and outlet opening 84 and defines a flow path, represented by dotted line 88, from inlet opening 82 to outlet opening 84. Flow path 88 is oriented generally parallel to vane 46, and to radially outer surface 58. Flow channel 86 is sized, shaped, and oriented to channel fluid along flow path 88 from inlet opening 82 to outlet opening 84. Inlet opening 82 is defined between adjacent upstream edges 74 of adjacent vanes 46. Outlet opening 84 is defined between adjacent downstream edges 76 of adjacent vanes 46. Each vane 46 includes an outer surface 90 and an opposite inner surface 92. Vane 46 extends between outer surface 90 and inner surface 92, and includes a height 94 defined between outer surface 90 and inner surface 92. Each vane 46 is formed with an arcuate shape and extends circumferentially about rotor disk 48 in a helical shape such that flow channel 86 has a spiral shape.

In the exemplary embodiment, each vane 46 includes a first side, i.e. a pressure side 96 and an opposing second side, i.e. a suction side 98. Each pressure side 96 and suction side 98 extends between upstream edge 74 and downstream edge 76. Each inlet opening 82 extends between pressure side 96 and an adjacent suction side 98 of vane 46 at upstream edge 74. Each outlet opening 84 extends between pressure side 96 and an adjacent suction side 98 at downstream edge 76. In the exemplary embodiment, flow channel 86 includes a width 100 that is defined between pressure side 96 and adjacent suction side 98 and is perpendicular to flow path 88.

In the exemplary embodiment, flow channel 86 defines a cross-sectional area 102 that varies along flow path 88. Cross-sectional area 102 of flow channel 86 is defined perpendicularly to flow path 88 and is equal to width 100 of flow channel 86 multiplied by height 94 of vane 46. Flow channel 86 includes a first area, i.e. an inlet cross-sectional area 104 at inlet opening 82, a second area, i.e. an outlet cross-sectional area 106 at outlet opening 84, and a third area, i.e. a minimum cross-sectional area 108 that is defined between inlet opening 82 and outlet opening 84. In the exemplary embodiment, minimum cross-sectional area 108 is less than inlet cross-sectional area 104 and outlet cross-sectional area 106.

Referring to FIGS. 3-5, in the exemplary embodiment, at least one supersonic compression ramp 110 is positioned within flow channel 86. Supersonic compression ramp 110 is positioned between inlet opening 82 and outlet opening 84, and is sized, shaped, and oriented to enable one or more compression waves 112 to form within flow channel 86. Supersonic compression ramp 110 is coupled to pressure side 96 of vane 46 and defines a throat region 114 of flow channel 86. Throat region 114 defines minimum cross-sectional area 108 of flow channel 86. Alternatively, supersonic compression ramp 110 may be coupled to suction side 98 of vane 46 and/or radially outer surface 58. In another alternative embodiment, supersonic compression ramp 110 is integrally formed with vane 46. In a further alternative embodiment, supersonic compressor rotor 40 includes a plurality of supersonic compression ramps 110 that are each coupled to pressure side 96, suction side 98, and/or radially outer surface 58. In such an embodiment, each supersonic compression ramp 110 collectively defines throat region 114.

Referring to FIG. 4, in the exemplary embodiment, supersonic compression ramp 110 includes a compression surface 116 and a diverging surface 118. Compression surface 116 includes a first edge, i.e. a leading edge 120 and a second edge, i.e. a trailing edge 122. Leading edge 120 is positioned closer to inlet opening 82 than trailing edge 122. Compression surface 116 extends between leading edge 120 and trailing edge 122 and is oriented at an oblique angle 124 from pressure side 96 towards adjacent suction side 98 and into flow path 88. Compression surface 116 converges towards an adjacent suction side 98 such that a compression region 126 is defined between leading edge 120 and trailing edge 122. Compression region 126 includes a cross-sectional area 128 of flow channel 86 that is reduced along flow path 88 from leading edge 120 to trailing edge 122. Trailing edge 122 of compression surface 116 defines throat region 114.

Diverging surface 118 is coupled to compression surface 116 and extends downstream from compression surface 116 towards outlet opening 84. Diverging surface 118 includes a first end 130 and a second end 132 that is closer to outlet opening 84 than first end 130. First end 130 of diverging surface 118 is coupled to trailing edge 122 of compression surface 116. Diverging surface 118 extends between first end 130 and second end 132 and is oriented at an oblique angle 134 from vane 46 towards adjacent suction side 98. Diverging surface 118 defines a diverging region 136 that includes a diverging cross-sectional area 138 that increases from trailing edge 122 of compression surface 116 to outlet opening 84. Diverging region 136 extends from throat region 114 to outlet opening 84.

Referring again to FIG. 5, in the exemplary embodiment, a shroud assembly 140 is coupled to outer surface 90 of each vane 46 such that flow channel 86 is defined between shroud assembly 140 and radially outer surface 58. Shroud assembly 140 includes a shroud plate 142 that extends between an inner edge 144 and an outer edge 146. Shroud plate 142 is coupled to each vane 46 such that upstream edge 74 of vane 46 is positioned adjacent inner edge 144 of shroud assembly 140, and downstream edge 76 of vane 46 is positioned adjacent outer edge 146 of shroud assembly 140. Alternatively, supersonic compressor rotor 40 does not include shroud assembly 140. In such an embodiment, a diaphragm assembly (not shown) is positioned adjacent each outer surface 90 of vanes 46 such that the diaphragm assembly at least partially defines flow channel 86.

In the exemplary embodiment, radially outer surface 58 includes an inlet surface 148, an outlet surface 150, and a transition surface 152 that extends between inlet surface 148 and outlet surface 150. Inlet surface 148 extends from upstream surface 60 to transition surface 152 and defines an inlet plane 154 within flow channel 86. Inlet plane 154 extends between adjacent vanes 46, and from upstream surface 60 to transition surface 152. Outlet surface 150 extends from transition surface 152 to downstream surface 62 and defines an outlet plane 156 within flow channel 86. Outlet plane 156 extends between adjacent vanes 46, and from transition surface 152 to downstream edge 76. Inlet plane 154 is not oriented parallel to outlet plane 156.

In the exemplary embodiment, inlet opening 82 is positioned a first radial distance 158 from centerline axis 54. Outlet opening 84 is positioned a second radial distance 160 from centerline axis 54 that is less than first radial distance 158. Inlet surface 148 is oriented substantially perpendicular to centerline axis 54 such that flow channel 86 defines a radial flow path 162 that extends along radial direction 64. Radial flow path 162 extends from inlet opening 82 to transition surface 152 and channels fluid in axial direction 72. Outlet surface 150 is oriented substantially parallel to centerline axis 54 such that flow channel 86 defines an axial flow path 164 that extends along radial direction 64. Axial flow path 164 extends from transition surface 152 to outlet opening 84 and channels fluid in axial direction 72. Transition surface 152 is formed with an arcuate shape and defines a transition flow path 166 that extends from inlet surface 148 to outlet surface 150. Transition surface 152 is oriented to channel fluid from radial direction 64 to axial direction 72 such that fluid is characterized by having a radial flow vector, represented by arrow 168, and am axial radial flow vector, represented by arrow 170 through transition flow path 166.

During operation of supersonic compressor rotor 40, intake section 12 (shown in FIG. 1) channels a fluid 172 towards inlet opening 82 of flow channel 86. Fluid 172 has a first velocity, i.e. an approach velocity, just prior to entering inlet opening 82. Supersonic compressor rotor 40 is rotated about centerline axis 54 at a second velocity, i.e. a rotational velocity, represented by arrow 174, such that fluid 172 entering flow channel 86 has a third velocity, i.e. an inlet velocity at inlet opening 82 that is supersonic relative to vanes 46. As fluid 172 is channeled through flow channel 86 at a supersonic velocity, supersonic compression ramp 110 contacts fluid 172 to cause compression waves 112 to form within flow channel 86 to facilitate compressing fluid 172, such that fluid 172 includes an increased pressure and temperature, and/or includes a reduced volume at outlet opening 84.

In the exemplary embodiment, fluid 172 enters inlet opening 82 and is channeled through radial flow path 162 along radial direction 64. As fluid enters transition flow path 166, flow channel 86 changes an orientation of fluid from radial direction 64 to axial direction 72 and channels fluid from radial flow path 162 to axial flow path 164. Fluid 172 is then discharged from axial flow path 164 through outlet opening 84 in axial direction 72.

During operation, supersonic compression ramp 110 is sized, shaped, and oriented to cause a system 176 of compression waves 112 to be formed within flow channel 86. System 176 includes a first oblique shockwave 178 that is formed as fluid 172 contacts leading edge 120 of supersonic compression ramp 110. Compression region 126 of supersonic compression ramp 110 is configured to cause first oblique shockwave 178 to be oriented at an oblique angle with respect to flow path 88 from leading edge 120 towards adjacent vane 46, and into flow channel 86. As first oblique shockwave 178 contacts adjacent vane 46, a second oblique shockwave 180 is reflected from adjacent vane 46 at an oblique angle with respect to flow path 88, and towards throat region 114 of supersonic compression ramp 110. Supersonic compression ramp 110 is configured to cause each first oblique shockwave 178 and second oblique shockwave 180 to form within compression region 126. As fluid is channeled through throat region 114 towards outlet opening 84, a normal shockwave 182 is formed within diverging region 136. Normal shockwave 182 is oriented perpendicular to flow path 88 and extends across flow path 88.

As fluid 172 passes through compression region 126, a velocity of fluid 172 is reduced as fluid 172 passes through each first oblique shockwave 178 and second oblique shockwave 180. In addition, a pressure of fluid 172 is increased, and a volume of fluid 172 is decreased. As fluid 172 passes through throat region 114, a velocity of fluid 172 is increased downstream of throat region 114 towards normal shockwave 182. As fluid passes through normal shockwave 182, a velocity of fluid 172 is decreased to a subsonic velocity with respect to rotor disk 48.

Figure 6:
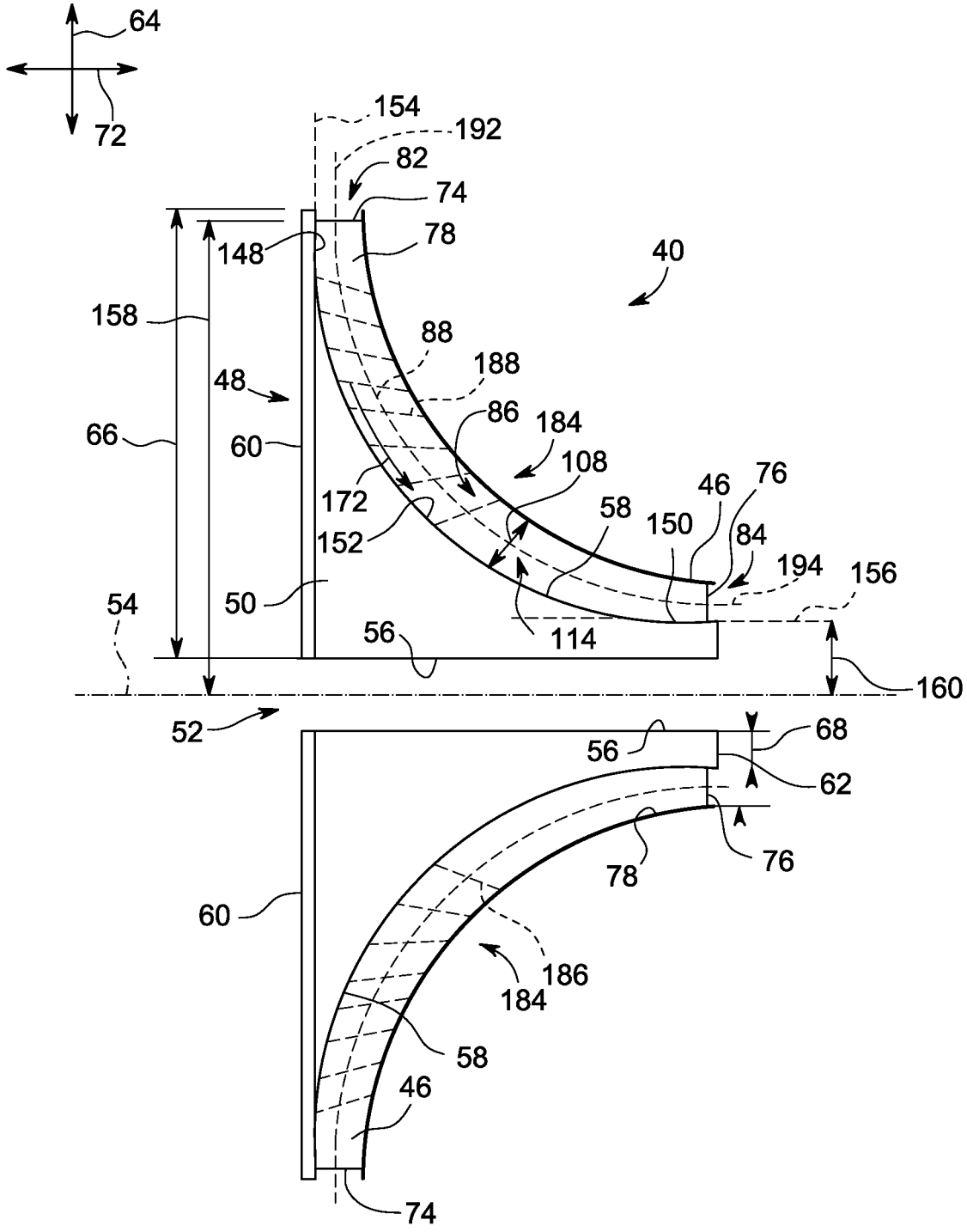
FIGS. 6-13 are cross-sectional views of alternative supersonic compressor rotors that may be used with the supersonic compressor system shown in FIG. 1.

FIGS. 6-13 are cross-sectional views of various alternative embodiments of supersonic compressor rotor 40. Identical components shown in FIGS. 6-13 are identified with the same reference numbers used in FIG. 5. Referring to FIG. 6, in one embodiment, radially outer surface 58 is oriented to cause a system 184 of isentropic compression waves 186 to form within flow channel 86, and between inlet opening 82 and outlet opening 84. In this embodiment, transition surface 152 of radially outer surface 58 is oriented to at least partially define throat region 114 of flow channel 86. As fluid 172 passes through compression region 126, a plurality of isentropic compression waves 186 are formed within compression region 126. In this alternative embodiment, an orientation of radially outer surface 58 prevents a formation of shockwaves within flow channel 86.

Figure 7:
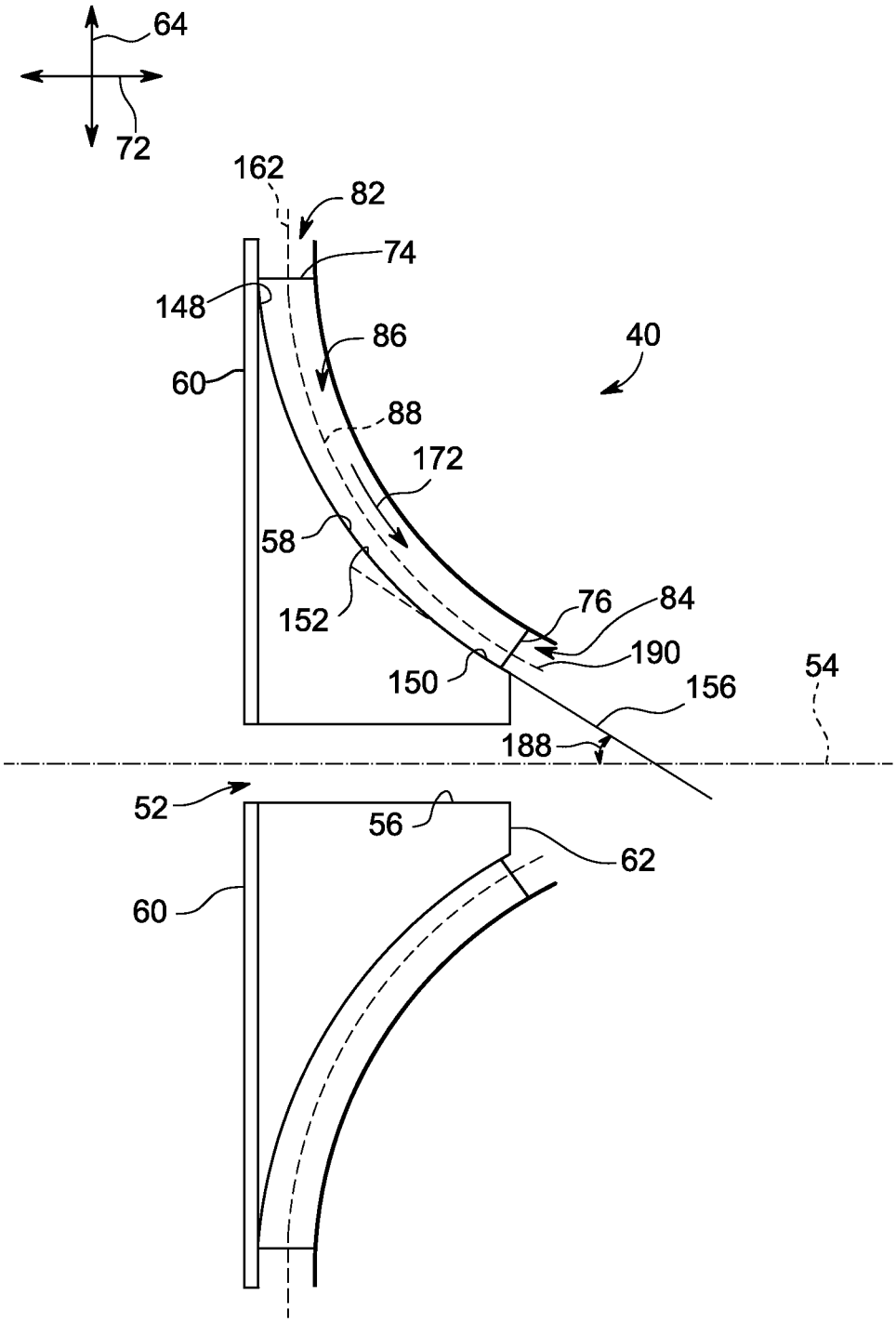

Referring to FIG. 7, in one embodiment, outlet surface 150 is oriented at an oblique angle 188 with respect to centerline axis 54 such that flow channel 86 defines an oblique flow path 190 at outlet opening 84. In this embodiment, flow channel 86 is configured to receive fluid along radial direction 64 and to discharge fluid 172 at oblique angle 188 from outlet opening 84.

Figure 8:
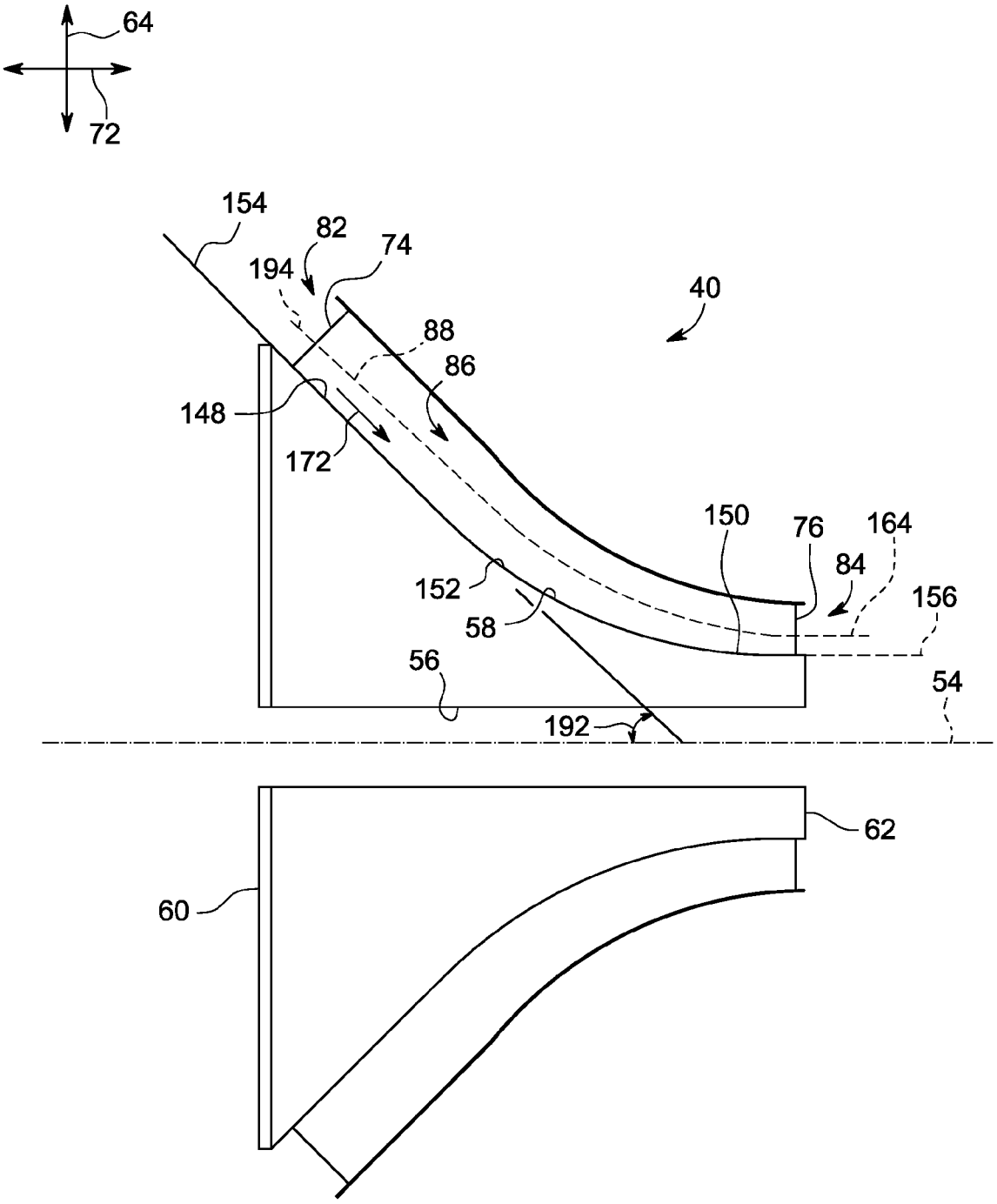

Referring to FIG. 8, in one embodiment, inlet surface 148 is oriented at an oblique angle 192 with respect to centerline axis 54 such that flow channel 86 defines an oblique flow path 194 at inlet opening 82. In this embodiment, flow channel 86 is configured to receive fluid at oblique angle 192 from inlet outlet opening 82 and discharge fluid 172 along axial direction 72 through outlet opening 84.

Figure 9:
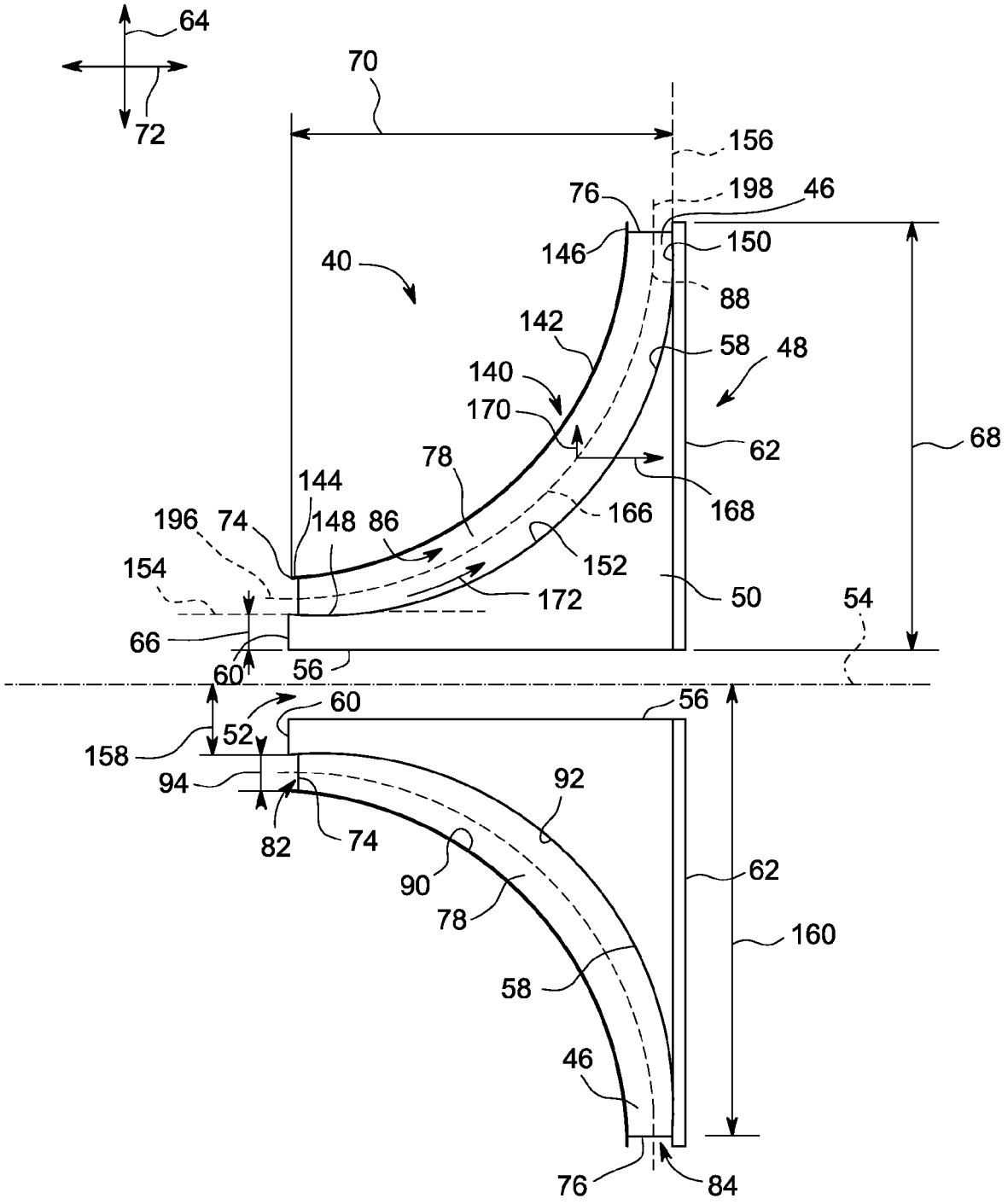

Referring to FIG. 9. in one embodiment, upstream surface 60 includes first radial width 66 that is less than second radial width 68 of downstream surface 62. First radial distance 158 of inlet opening 82 is less than second radial distance 160 of outlet opening 84. Inlet surface 148 is oriented substantially parallel to centerline axis 54 such that flow channel 86 defines an axial flow path 196 at inlet opening 82 that extends in axial direction 72. Outlet surface 150 is oriented substantially perpendicular to centerline axis 54 such that flow channel 86 defines a radial flow path 198 at outlet opening 84 that extends along radial direction 64. Transition surface 152 is oriented to channel fluid from axial direction 72 to radial direction 64 through flow channel 86.

Figure 10:
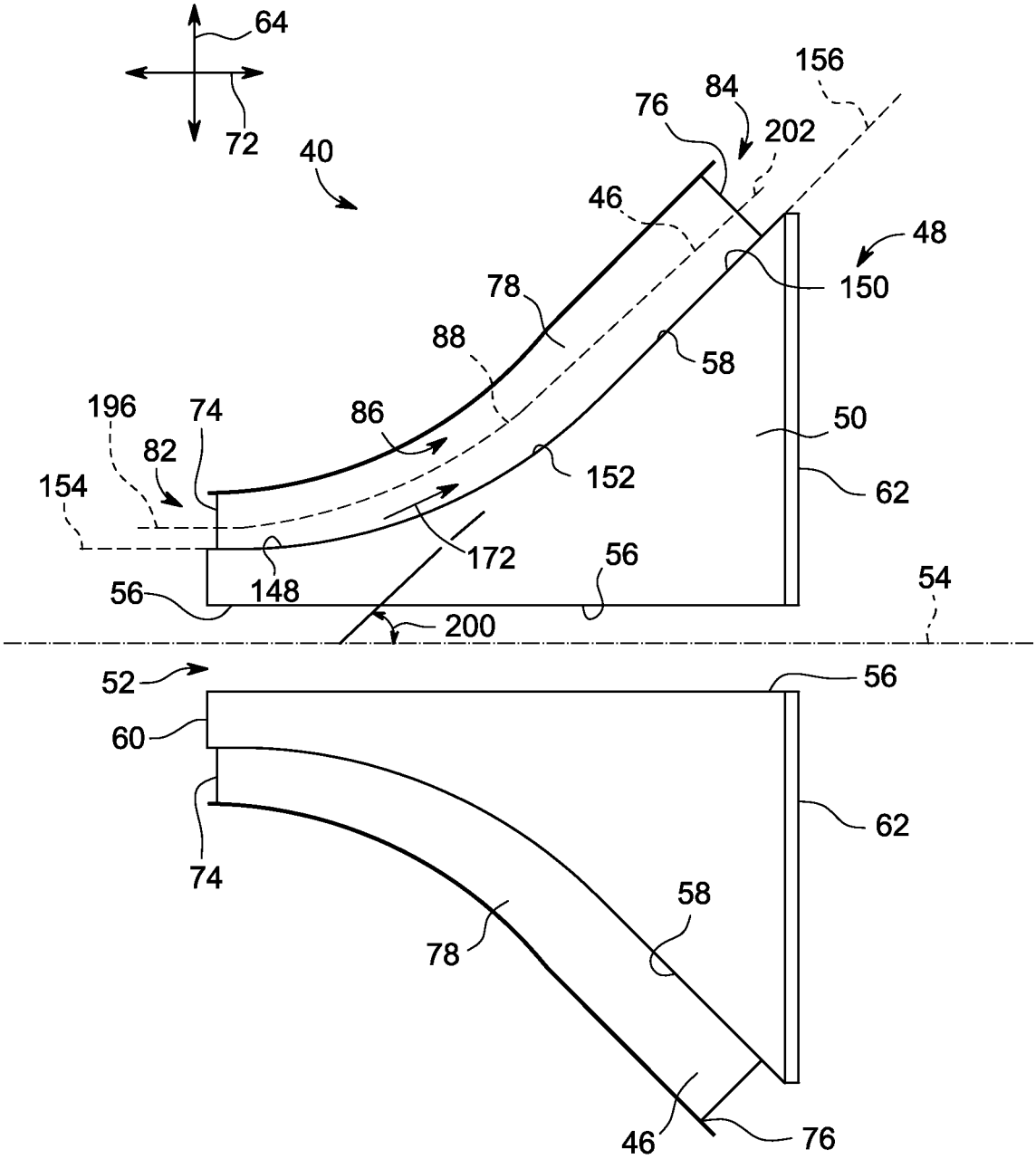

Referring to FIG. 10, in one embodiment, outlet surface 150 is oriented at an oblique angle 200 with respect to centerline axis 54 such that flow channel 86 defines oblique flow path 202 at outlet opening 84. In this embodiment, flow channel 86 is configured to receive fluid along axial direction 72 and to discharge fluid 172 at oblique angle 202 from outlet opening 84.

Figure 11:
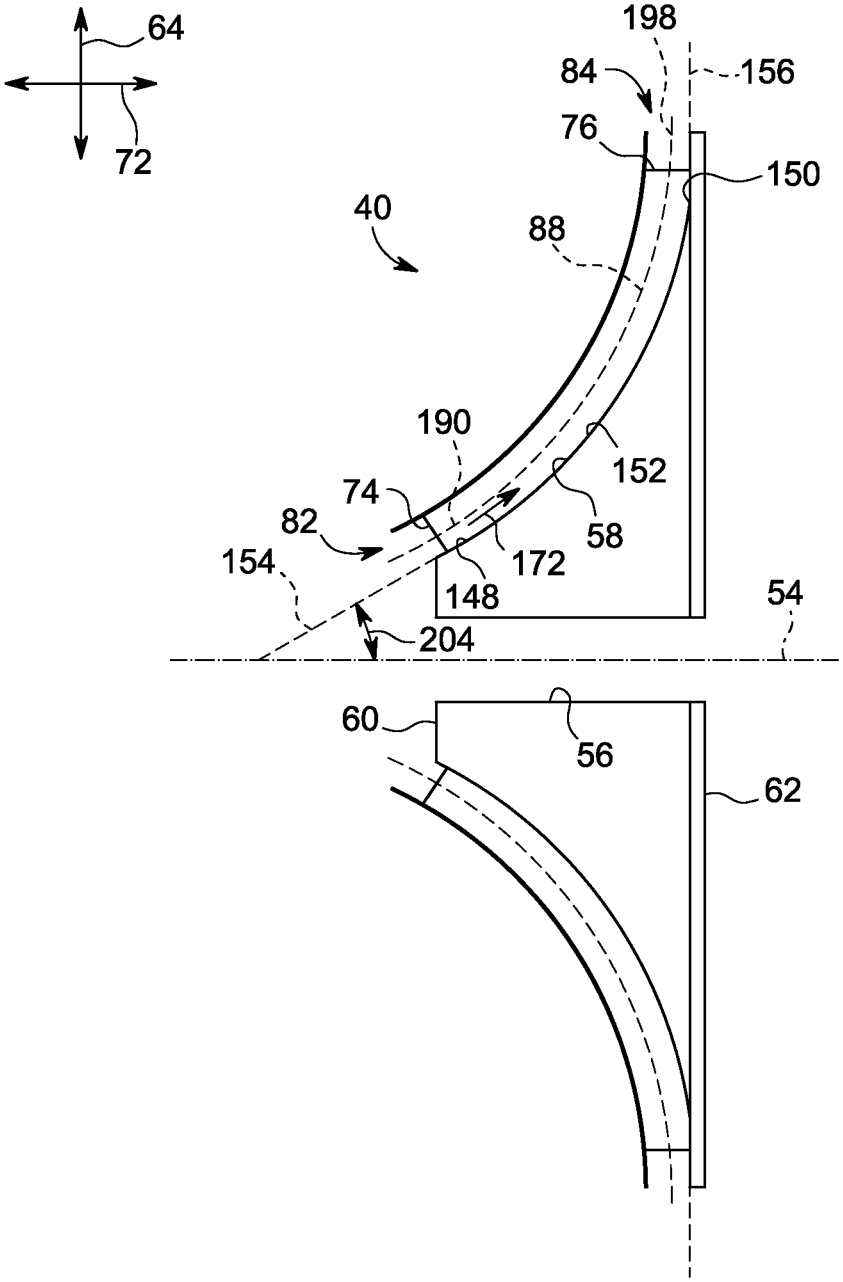

Referring to FIG. 11, in one embodiment, inlet surface 148 is oriented at an oblique angle 204 with respect to centerline axis 54 such that flow channel 86 defines oblique flow path 190 at inlet opening 82. Outlet surface 150 is oriented substantially perpendicular to centerline axis 54 such that flow channel 86 defines radial flow path 198 at outlet opening 84. In this embodiment, flow channel 86 is configured to receive fluid at oblique angle 204 from inlet outlet opening 82 and discharge fluid 172 along radial direction 64 through outlet opening 84.

Figure 12:
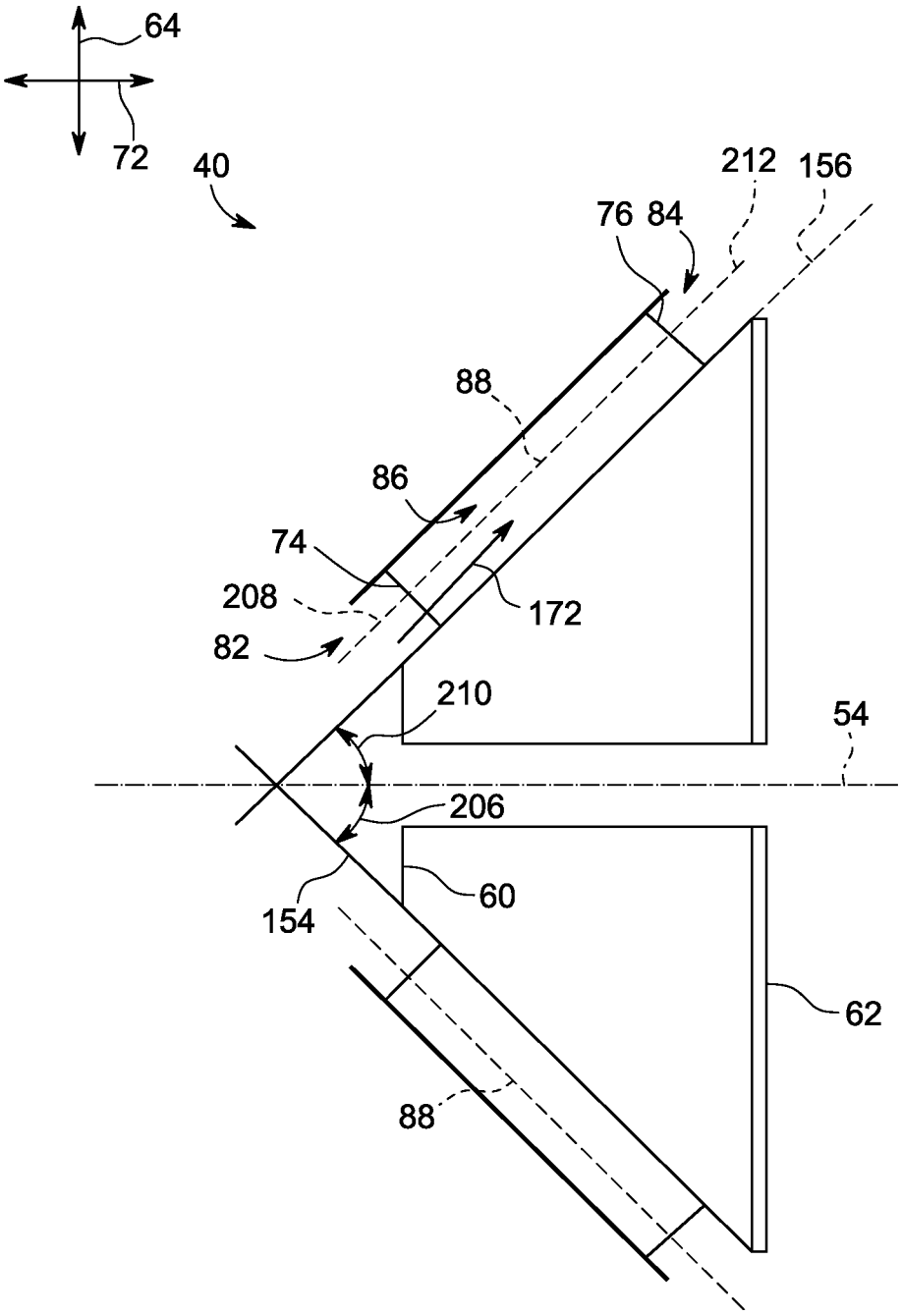

Referring to FIG. 12, in one embodiment, inlet surface 148 is oriented at a first oblique angle 206 with respect to centerline axis 54 such that flow channel 86 defines a first oblique flow path 208 at inlet opening 82. Outlet surface 150 is oriented at a second oblique angle 210 with respect to centerline axis 54 such that flow channel 86 defines a second oblique flow path 212 at outlet opening 84. In this embodiment, flow channel 86 is configured to receive fluid at first oblique angle 206 from inlet outlet opening 82 and discharge fluid 172 at second oblique angle 210 through outlet opening 84.

Figure 13:
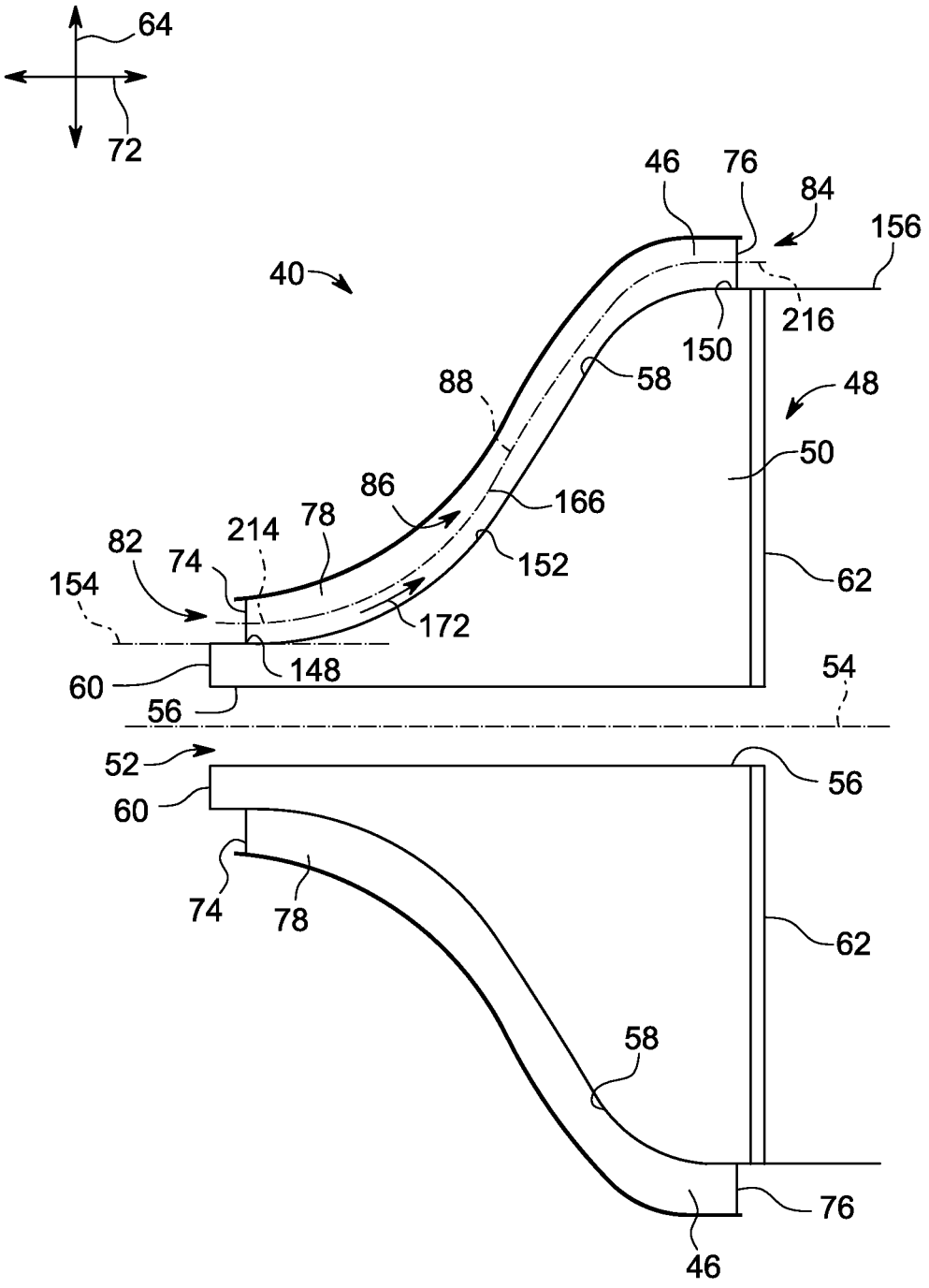

Referring to FIG. 13, in one embodiment, inlet surface 148 is oriented substantially parallel to centerline axis 54 such that flow channel 86 defines a first axial flow path 214 at inlet opening 82. Outlet surface 150 is oriented substantially parallel to centerline axis 54 such that flow channel 86 defines a second axial flow path 216 at outlet opening 84. In this embodiment, flow channel 86 is configured to receive fluid 172 along axial direction 72 and discharge fluid 172 along axial direction 72.

The above-described supersonic compressor rotor provides a cost effective and reliable method for channeling a fluid from an axial direction to a radial direction or channeling a fluid from a radial direction to an axial direction. More specifically, the supersonic compressor rotor includes a flow channel that includes a transition surface that adjusts an orientation of a flow path through the flow channel. Moreover, the embodiments described herein include a supersonic compression rotor that includes an inlet surface and an outlet surface that is not parallel to the inlet surface. In addition, by providing a supersonic compressor rotor with a flow channel that channels fluid from an axial direction to a radial direction, the supersonic compressor rotor enables a supersonic compressor system to be designed to include each of an axial intake orientation, a radial intake orientation, an axial discharge orientation, and/or a radial discharge orientation. As a result, the supersonic compressor rotor described herein overcomes the flow path orientation limitations of known supersonic compressor assemblies. As such, the cost of manufacturing and maintaining the supersonic compressor system may be reduced.

Exemplary embodiments of systems and methods for assembling a supersonic compressor rotor are described above in detail. The system and methods are not limited to the specific embodiments described herein, but rather, components of systems and/or steps of the method may be utilized independently and separately from other components and/or steps described herein. For example, the systems and methods may also be used in combination with other rotary engine systems and methods, and are not limited to practice with only the supersonic compressor system as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A supersonic compressor rotor comprising:

a rotor disk comprising an upstream surface, a downstream surface, and a radially outer surface that extends between said upstream surface and said downstream surface, said radially outer surface comprising an inlet surface, an outlet surface, and a transition surface extending between said inlet surface and said outlet surface, said rotor disk defining a centerline axis;

a plurality of vanes coupled to said radially outer surface, adjacent said vanes forming a pair and oriented such that a flow channel is defined between each said pair of adjacent vanes, said flow channel extending between an inlet opening and an outlet opening, said inlet surface defining an inlet plane extending between said inlet opening and said transition surface, said outlet surface defining an outlet plane extending between said outlet opening and said transition surface that is not parallel to said inlet plane; and at least one supersonic compression ramp comprising a trailing edge defining a uniform throat positioned within said flow channel to facilitate forming at least one compression wave within said flow channel.

2. The supersonic compressor rotor in accordance with claim 1, wherein said inlet surface is oriented substantially parallel with respect to said centerline axis such that said flow channel defines an axial flow path from said inlet opening to said transition surface, said outlet surface is oriented at an oblique angle with respect to said centerline axis such that said flow channel defines an oblique flow path from said transition surface to said outlet opening.

3. The supersonic compressor rotor in accordance with claim 1, wherein said inlet surface is oriented substantially parallel with respect to said centerline axis such that said flow channel defines an axial flow path from said inlet opening to said transition surface, said outlet surface is oriented substantially perpendicular with respect to said centerline axis such that said flow channel defines a radial flow path from said transition surface to said outlet opening.

4. The supersonic compressor rotor in accordance with claim 1, wherein said inlet surface is oriented substantially perpendicular with respect to said centerline axis such that said flow channel defines a radial flow path from said inlet opening to said transition surface, said outlet surface is oriented substantially parallel with respect to said centerline axis such that said flow channel defines an axial flow path from said transition surface to said outlet opening.

5. The supersonic compressor rotor in accordance with claim 1, wherein said inlet surface is oriented substantially perpendicular with respect to said centerline axis such that said flow channel defines a radial flow path from said inlet opening to said transition surface, said outlet surface is oriented at an oblique angle with respect to said centerline axis such that said flow channel defines an oblique flow path from said transition surface to said outlet opening.

6. The supersonic compressor rotor in accordance with claim 1, wherein said inlet surface is oriented at an oblique angle with respect to said centerline axis such that said flow channel defines an oblique flow path from said inlet opening to said transition surface, said outlet surface is oriented substantially parallel with respect to said centerline axis such that said flow channel defines an axial flow path from said transition surface to said outlet opening.

7. The supersonic compressor rotor in accordance with claim 1, wherein said inlet surface is oriented at an oblique angle with respect to said centerline axis such that said flow channel defines an oblique flow path from said inlet opening to said transition surface, said outlet surface is oriented substantially perpendicular with respect to said centerline axis such that said flow channel defines a radial flow path from said transition surface to said outlet opening.

8. The supersonic compressor rotor in accordance with claim 1, wherein said inlet surface is oriented at an oblique angle with respect to said centerline axis such that said flow channel defines an oblique flow path from said inlet opening to said transition surface, said outlet surface is oriented at an oblique angle with respect to said centerline axis such that said flow channel defines an oblique flow path from said transition surface to said outlet opening.

9. A supersonic compressor system comprising:

a casing defining a cavity extending between a fluid inlet and a fluid outlet;

a drive shaft positioned within said casing and defining a centerline axis, said drive shaft rotatably coupled to a driving assembly; and a supersonic compressor rotor coupled to said drive shaft, said supersonic compressor rotor positioned between said fluid inlet and said fluid outlet for channeling fluid from said fluid inlet to said fluid outlet, said supersonic compressor rotor comprising:

a rotor disk comprising an upstream surface, a downstream surface, and a radially outer surface that extends between said upstream surface and said downstream surface, said radially outer surface comprising an inlet surface, an outlet surface, and a transition surface extending between said inlet surface and said outlet surface;

a plurality of vanes coupled to said radially outer surface, adjacent said vanes forming a pair and oriented such that a flow channel is defined between each said pair of adjacent vanes, said flow channel extending between an inlet opening and an outlet opening, said inlet surface defining an inlet plane extending between said inlet opening and said transition surface, said outlet surface defining an outlet plane extending between said outlet opening and said transition surface that is not parallel to said inlet plane; and at least one supersonic compression ramp comprising a trailing edge defining a uniform throat positioned within said flow channel to facilitate forming at least one compression wave within said flow channel.

10. The supersonic compressor system in accordance with claim 9, wherein said inlet surface is oriented substantially parallel with respect to said centerline axis such that said flow channel defines an axial flow path from said inlet opening to said transition surface, said outlet surface is oriented at an oblique angle with respect to said centerline axis such that said flow channel defines an oblique flow path from said transition surface to said outlet opening.

11. The supersonic compressor system in accordance with claim 9, wherein said inlet surface is oriented substantially parallel with respect to said centerline axis such that said flow channel defines an axial flow path from said inlet opening to said transition surface, said outlet surface is oriented substantially perpendicular with respect to said centerline axis such that said flow channel defines a radial flow path from said transition surface to said outlet opening.

12. The supersonic compressor system in accordance with claim 9, wherein said inlet surface is oriented substantially perpendicular with respect to said centerline axis such that said flow channel defines a radial flow path from said inlet opening to said transition surface, said outlet surface is oriented substantially parallel with respect to said centerline axis such that said flow channel defines an axial flow path from said transition surface to said outlet opening.

13. The supersonic compressor system in accordance with claim 9, wherein said inlet surface is oriented substantially perpendicular with respect to said centerline axis such that said flow channel defines a radial flow path from said inlet opening to said transition surface, said outlet surface is oriented at an oblique angle with respect to said centerline axis such that said flow channel defines an oblique flow path from said transition surface to said outlet opening.

14. The supersonic compressor system in accordance with claim 9, wherein said inlet surface is oriented at an oblique angle with respect to said centerline axis such that said flow channel defines an oblique flow path from said inlet opening to said transition surface, said outlet surface is oriented substantially parallel with respect to said centerline axis such that said flow channel defines an axial flow path from said transition surface to said outlet opening.

15. The supersonic compressor system in accordance with claim 9, wherein said inlet surface is oriented at an oblique angle with respect to said centerline axis such that said flow channel defines an oblique flow path from said inlet opening to said transition surface, said outlet surface is oriented substantially perpendicular with respect to said centerline axis such that said flow channel defines a radial flow path from said transition surface to said outlet opening.

16. The supersonic compressor system in accordance with claim 9, wherein said inlet surface is oriented at an oblique angle with respect to said centerline axis such that said flow channel defines an oblique flow path from said inlet opening to said transition surface, said outlet surface is oriented at an oblique angle with respect to said centerline axis such that said flow channel defines an oblique flow path from said transition surface to said outlet opening.

17. A method of assembling a supersonic compressor rotor, said method comprising:

providing a rotor disk that includes an upstream surface, a downstream surface, and a radially outer surface that extends between the upstream surface and the downstream surface, the radially outer surface including an inlet surface, an outlet surface, and a transition surface extending between the inlet surface and the outlet surface, the rotor disk defining a centerline axis;

coupling a plurality of vanes to the radially outer surface, adjacent vanes forming a pair and oriented such that a flow channel is defined between each pair of adjacent vanes, the flow channel extending between an inlet opening and an outlet opening, the inlet surface defining an inlet plane extending between the inlet opening and the transition surface, the outlet surface defining an outlet plane extending between the outlet opening and the transition surface that is not parallel to the inlet plane; and coupling at least one supersonic compression ramp to one of a vane of the plurality of vanes and the radially outer surface, the supersonic compression ramp positioned within the flow channel and configured to facilitate forming at least one compression wave within the flow channel.

18. The method in accordance with claim 17, further comprising:

providing the inlet surface oriented substantially parallel with respect to the centerline axis and defining an axial flow path; and providing the outlet surface oriented with respect to the centerline axis to define one of a radial flow path and an oblique flow path.

19. The method in accordance with claim 17, further comprising:

providing the inlet surface oriented substantially perpendicular with respect to the centerline axis and defining a radial flow path from the inlet opening to the transition surface; and providing the outlet surface oriented with respect to the centerline axis to define one of an axial flow path and an oblique flow path.

20. The method in accordance with claim 17, further comprising:

providing the inlet surface oriented at an oblique angle with respect to the centerline axis and defining an oblique flow path from the inlet opening to the transition surface; and providing the outlet surface oriented with respect to the centerline axis to define one of an axial flow path, a radial flow path, and an oblique flow path.

* * * * *